US005897015A

United States Patent [19]

Sheahan

[11] Patent Number: 5,897,015

[45] **Date of Patent: *Apr. 27, 1999**

[54] DISC SHAPED CONTAINER

[75] Inventor: Mark Sheahan, London, United Kingdom

[73] Assignee: Courtaulds Packaging Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/696,893

[22] PCT Filed: Mar. 1, 1995

[86] PCT No.: PCT/GB95/00436

§ 371 Date: Aug. 21, 1996

§ 102(e) Date: Aug. 21, 1996

[87] PCT Pub. No.: WO95/23743

PCT Pub. Date: Sep. 8, 1995

[30] Foreign Application Priority Data

Mar. 4, 1994 [GB] United Kingdom ..... 9404234

[51] Int. Cl.[6] ..... B65D 41/00

[52] U.S. Cl. ..... 220/281; 220/780

[58] Field of Search ..... 220/281, 780, 220/790, 351, 4.21, 669, 657, 659

[56] References Cited

U.S. PATENT DOCUMENTS

| | | | |
|---|---|---|---|
| 1,376,939 | 5/1921 | Hornung . | |
| 1,418,090 | 5/1922 | Matter | 220/281 |
| 2,706,065 | 4/1955 | Stone | 220/4.21 X |
| 3,172,559 | 3/1965 | Thompson | 220/780 X |
| 3,484,016 | 12/1969 | Turner | 220/281 |
| 5,368,178 | 11/1994 | Towns et al. | 220/780 X |

FOREIGN PATENT DOCUMENTS

| | | |
|---|---|---|
| 1804238 | 10/1968 | Germany . |
| 203568 | 8/1939 | Switzerland . |
| 354368 | 5/1930 | United Kingdom . |

*Primary Examiner*—Steven M. Pollard
*Attorney, Agent, or Firm*—Iandiorio & Teska

[57] ABSTRACT

A disc shaped container (2) comprising a body portion (4) and a lid (6) which is a press fit on the body portion (4); the body portion (4) having a base (8), a circumferential side wall (10) and a groove (12) in an outer face (14) of the side wall (10); the lid (6) having a top (16) and a circumferential side wall (18); the container (2) being such that the side wall (18) of the lid (6) overlaps the side wall (10) of the body portion (4) when the lid (6) is on the body portion (4); and the body portion (4) and the lid (6) both being made of a plastics material such that the side wall (18) of the lid (6) is pressable into the groove (12) in the outer face (14) of the side wall (10) of the body portion (4) in order to cause the lid (6) to separate from the body portion (4) with a sliding action.

9 Claims, 3 Drawing Sheets

A

DISC SHAPED CONTAINER

This invention relates to a disc shaped container.

Disc shaped containers are well known. One extremely well known disc shaped container is a shoe polish container which contains shoe polish for different types of footwear, The known disc shaped containers may generally include any suitable and appropriate material so that, in addition to shoe polish, the containers may contain polish for example for handbags or furniture, or cosmetic creams for example for faces or hands or hair gels, toothpaste powder or pharmaceuticals. In addition to being disc shaped, the known containers are constructed to be held in a person's hand and they have a body portion and a lid. The lid is usually a press fit on the body portion. The lid is usually removed from the body portion by a twisting and pulling action or by rotating a lid-engaging device which forces the lid away from the body portion.

The known disc shaped containers are traditionally made of metal and although the manufacture of the containers has been improved over the years with advances in technology, the manufacture of the containers is still not as easy as it might be, not only with regard to the manufacture of the containers but also with regard to the printing of the containers with appropriate advertising material and instructions.

It is an aim of the present invention to reduce the above mentioned problem.

Accordingly, the present invention provides a disc shaped container comprising a body portion and a lid which is a press fit onto the body portion; the body portion having a base, a circumferential side wall having an outer face with an annular groove forked in the outer face of the side wall, the groove having a pair of sides comprising a first side adjacent the base and a second side away from the base, and the lid having a top and a circumferential side wall; the container being such that the lid side wall overlaps the body portion side wall when the lid is on the body portion; the body portion and the lid both being made of a plastics material such that the lid side wall is pressable into said groove causing the lid side wall to engage said first side of the groove as the side wall is pressed into the groove, in order to cause the lid to separate from the body portion with a sliding action; and the lid has an inwardly projecting body portion-engaging part adjacent the top that is engageable with the second side of said groove so that the lid is maintained in its closed position; and the lid being capable of repeated fitting to and separation from the body portion.

The use of a plastics material for producing the disc shaped container of the present invention enables manufacturers to take advantage of plastics moulding techniques which cannot be used when working in metal such as tin. The plastics material lends itself to being embossed to receive appropriate advertising designs. The disc shaped container lends itself to being printed and/or labelled, due to the ability of the container to be produced with flat exterior surfaces for the lid top and side wall and for the base of the body portion. The printing may be effected, for example, with pad printers for printing on the base of the body portion and the top of the lid, and with rotary printers for printing on the side walls of the lid and/or the body portion.

The disc shaped container of the present invention can be produced to be the same size as existing disc shaped containers made of tin so that there is no need for manufacturers to change their packaging. The disc shaped container of the present invention can also be made to look as similar as possible to existing disc shaped containers made of tin, in order to reduce any resistance of the general public to buying and using a new type of disc shaped container.

The removal of the lid from the body portion is simply effected by pressing on the side wall of the lid. A person pressing on the side wall of the lid can feel the groove in the side wall of the body portion. The user of the disc shaped container always feels that the removal of the lid is being effected under their full control, which is often not the case with disc shaped containers made of tin where a large separating force has to be applied and the lid suddenly comes away from the body portion, rather than in a controlled manner as occurs with the disc shaped container of the present invention. With the disc shaped container of the present invention, a simple press and release action on the side wall of the lid may be employed in order to cause the body portion to separate from the lid and, for example, fall into one hand of a person whilst their other hand retains hold of the lid.

Preferably, the container is one in which the first side of the groove is a concave side.

When the container has the groove with the concave side, then the container is preferably one in which the body portion has a formation which leads into the concave side of the groove and which acts to facilitate an initial separating movement of the lid from the body portion, the formation being a convex formation.

The side wall of the lid may have a bead portion for sliding over the formation during the initial separating movement, the bead portion being thicker than an adjacent part of the side wall of the lid. Such a lid construction enables a relatively thin side wall to be used, with the bead then helping to keep the lid in shape. In an alternative construction, the side wall of the lid may have a radiused end remote from the cover, the radiused end being for sliding over the formation during the initial separating movement. In this alternative formation of the lid, the side wall will usually be thicker than when a bead is employed.

The container may be one in which the top and the side wall of the lid are of such a thickness that the lid is able to assume a slight elliptical shape when the side wall is pressed into the groove, thereby to reduce the contact area between the lid and the body portion and thereby to reduce the friction between the lid and the body portion and to facilitate removal of the lid from the body portion.

The container may be one in which the side wall of the body portion has an inwardly inclined outer surface part at its end remote from the base, and in which the side wall of the lid has an inclined part between its two ends, the inwardly inclined outer surface part of the side wall of the body portion and the inclined part of the side wall of the lid being such as to engage each other when the side wall of the lid is pressed fully into the groove, and to ensure that the lid is able to continue being slid away from the body portion when finger pressure pressing the side wall of the lid into the groove is released.

The container may be one in which the top of the lid has an inclined shoulder part which is positioned adjacent an inner surface of the end of the side wall of the body portion remote from the base when the container is closed, the inclined shoulder part being such as to act to force any contents of the container that are on the end of the side wall of the body portion back into the body portion. Such an arrangement may be especially useful for container contents such as boot polish which, during dispensation, will often get around the open end of the body portion.

The base of the body portion may have a plain inner surface. With known disc shaped containers made of, tin, especially those used for shoe polish, there are usually grooves on the inner surface of the base of the body portion and the shoe polish stays in these grooves. It is believed that users tend to retain the containers longer trying to get the last bit of polish out of the grooves. With a plain inner surfaces it is believed that people will use up the contents of the container more quickly than if the grooves are present. Naturally, if desired, then the base of the bottom portion may have a grooved inner surface.

The base of the body portion preferably has a single groove in its outer surface. This groove is able to enable the body portion to be moulded with a substantially even distribution of moulding material without the need to employ a mould core. If desired, the lid may also be provided with a grooved outer surface.

Preferably, the side wall of the body portion has an inner surface which is provided with at least one circumferentially extending rib. This is to help to retain the contents of the container in the body portion in the event that the contents should become dry and cracked. If desired however, the side wall of the body portion may be plain or grooved on its inner surface.

The side wall of the lid may have a formation on its outer surface for indicating where the side wall of the lid should be pressed in order to open a container. The formation may be a raised formation with a depression therein for receiving fingers and a thumb of a person squeezing the lid.

The container may be one in which at least one of the lid and the body portion has a formation for preventing sealing of the body portion when the container is closed. This will then allow the contents of the container to breath, for example as is traditional in the case of shoe polish where the metal disc shaped containers are usually provided with a pip/venting point to prevent sealing. The breathing is desirable because the shoe polish contains solvents.

The container may be one at least one of the lid-engaging part on the body portion and the body portion-engaging part on the lid is provided with the formation for preventing the sealing of the body portion when the container is closed. The formation is preferably a channel but it may be some other type of formation such for example as knurling if desired. Generally, any suitable and appropriate formation may be employed.

If desired, the container of the present invention may be one in which the lid seals the body portion when the container is closed. Generally, the decision whether or not to have the lid completely sealing the body portion will depend upon the type of material being stored in the container. Generally, the disc shaped container of the present invention can contain any suitable and appropriate material, including those materials currently stored in similar disc shaped containers made of metal.

The container of the present invention will usually be such that the lid and the body portion are made of the same plastics materials. Different plastics materials for the lid and the body portion may however be employed if desired. A presently preferred plastics material for both the lid and the body portion is polypropylene. Other plastics materials may be employed.

Embodiments of the invention will now be described solely by way of example and with reference to the accompanying drawings in which.

Figure 1:
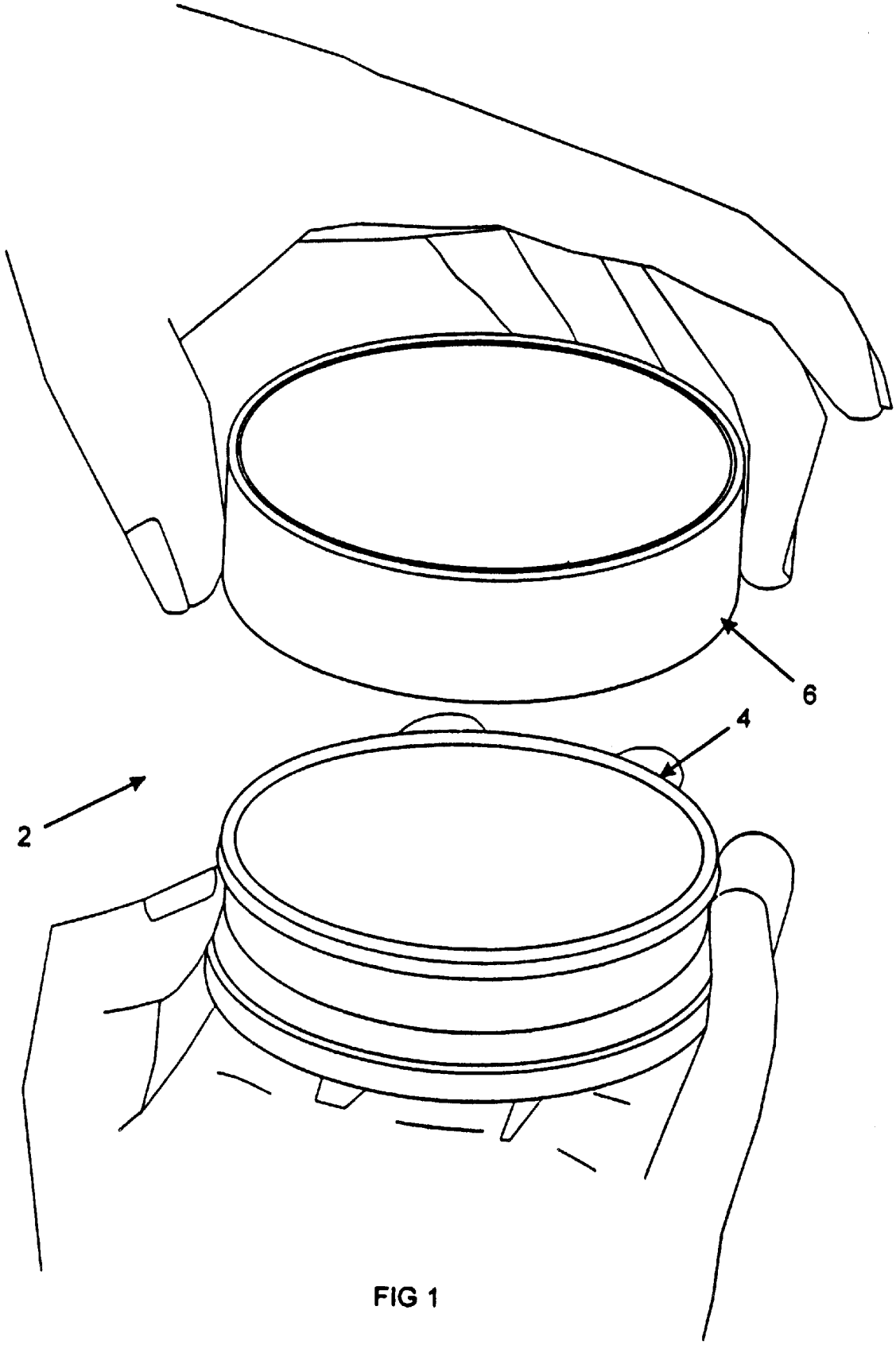
FIG. 1 is a perspective view of a first disc shaped container in an open condition.

Referring to the drawings, there is shown a disc shaped container 2 comprising a body portion 4 and a lid 6 which is a press fit on the body portion 4.

The body portion 4 has a base 8, a circumferential side wall 10 and a groove 12 in an outer face 14 of the side wall 10. The lid 6 has a top 16 and a circumferential side wall 18.

Figures 2, 3, 4, 5, 6, 7, 8, 9:
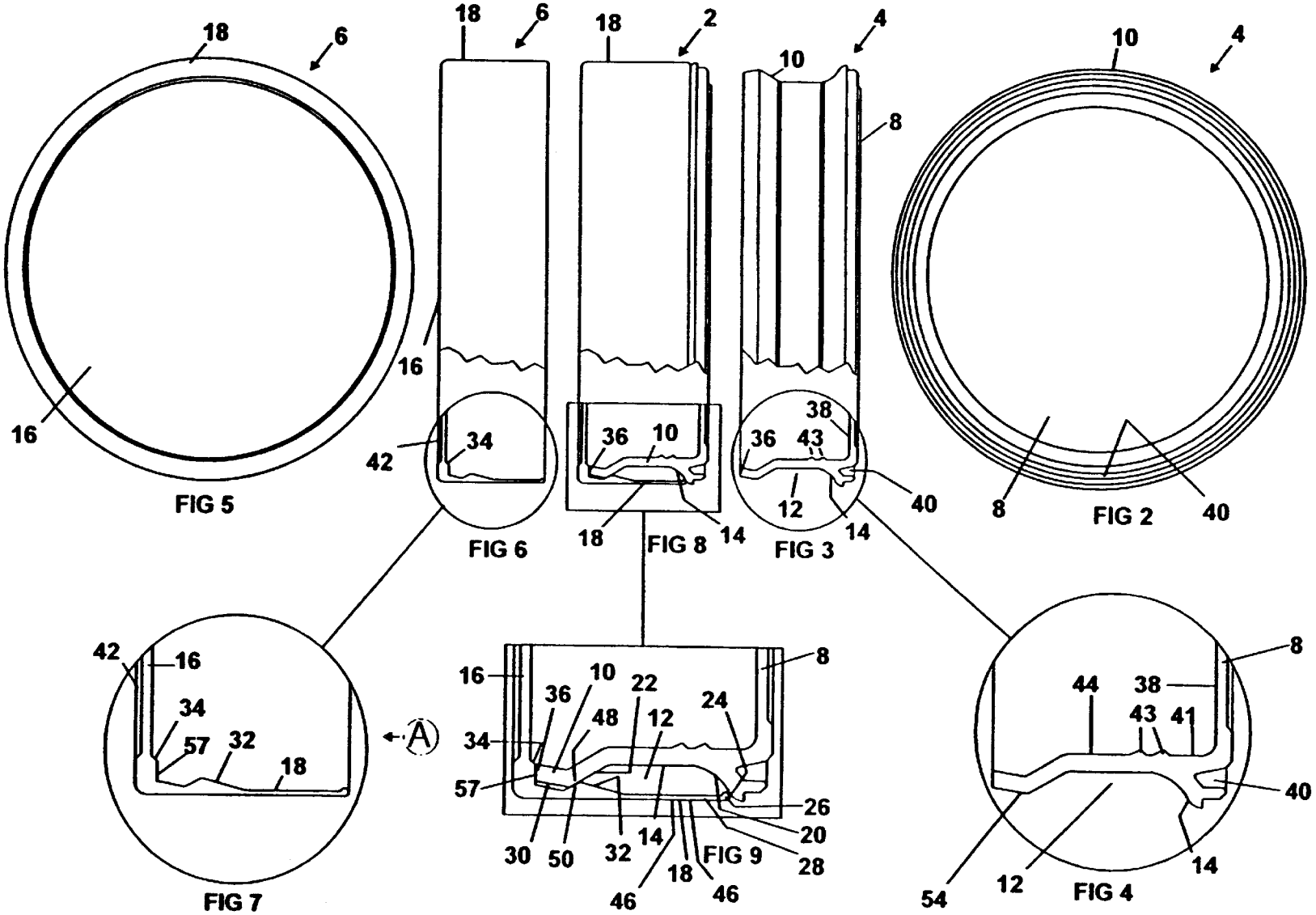
FIG. 2 is a bottom view of a body portion of the container shown in FIG. 1.
FIG. 3 is a side view of the body portion shown in FIG. 2.
FIG. 4 is an enlarged view of part of the body portion shown in FIG. 3.
FIG. 5 is a top view of a lid forming part of the container shown in FIG. 1.
FIG. 6 is a side view of the lid shown in FIG. 5.
FIG. 7 is an enlarged view of part of the lid as shown in FIG. 6.
FIG. 8 is a side view, partially in section, of the container shown in FIG. 1 with the lid of FIG. 5 on the body portion of FIG. 2.
FIG. 9 is an enlarged sectional view of part of the disc shaped container as shown in FIG. 8.
Figure 11:
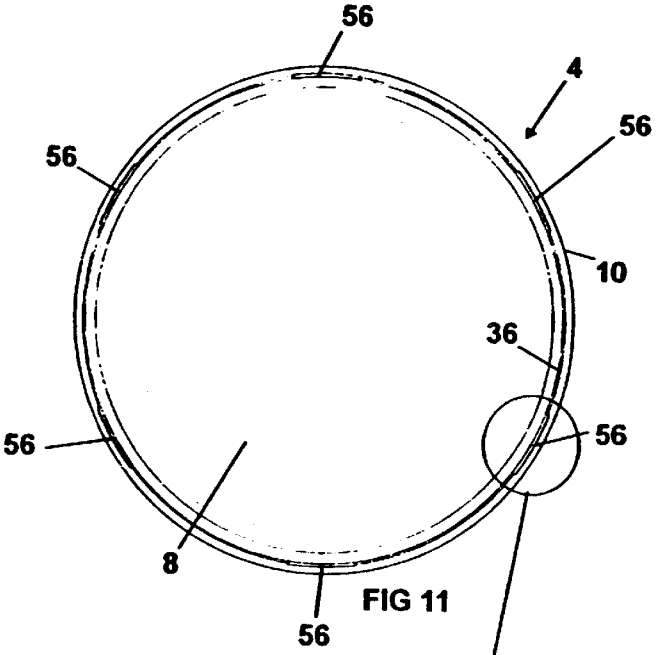
FIG. 11 is a top plan view of a body portion for a second disc shaped container.
Figure 12:
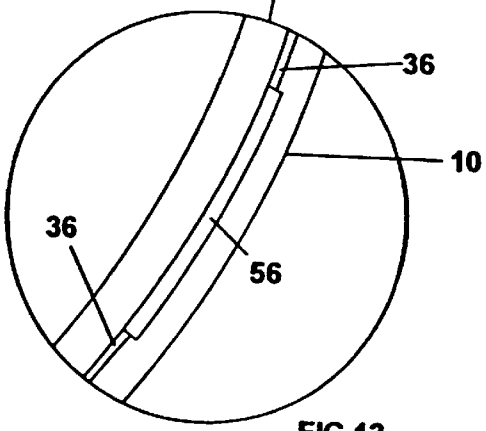
FIG. 12 is an enlarged view of the part which is circled in FIG. 11.
Figure 13:
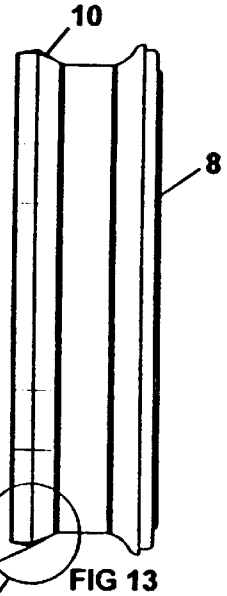
FIG. 13 is a side view of the body portion shown in FIG. 11.
Figure 14:
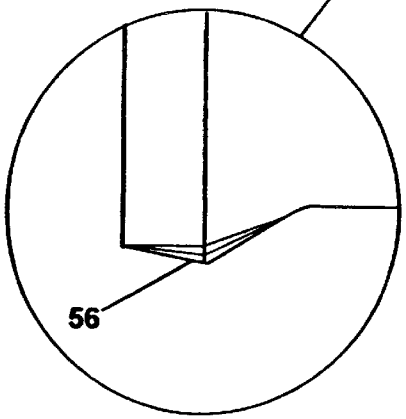
FIG. 14 is an enlarged view of the part which is circled in FIG. 13.

The container 2 is such that the side wall 18 of the lid 6 overlaps the side wall 10 of the body portion 4 when the lid 6 is on the body portion 4, as can best be seen in FIGS. 8 and 9. The body portion 4 and the lid 6 are both made of a polypropylene plastics material and in thicknesses such that the side wall 18 of the lid 6 is pressable into the groove 12 in the outer face 14 of the side wall 10 of the body portion 4, in order to cause the lid 6 to separate from the body portion 4 with a sliding action.

As can best be seen from FIG. 9, the groove 12 is defined by a pair of sides 20, 22. The side 20 is the side of the groove 12 nearest the base 8. As can be seen, this side 20 is a concave side 20. This side 20 engages the side wall 18 of the lid 6 and forces the lid 6 away from the body portion 4 as the side wall 18 of the lid 6 is pressed into the groove 12.

As can best be seen from FIG. 9, the body portion 4 has a formation 24 which leads into the concave side 20 and which acts to facilitate an initial separating movement of the lid 6 from the body portion 4. The formation 24 is a convex formation as shown.

The side wall 18 of the lid 6 has a bead portion 26 for sliding over the formation 24 during the initial separating movement. The bead portion 26 is thicker than an adjacent part 28 of the side wall 18 of the lid 6. In an alternative embodiment of the invention (not shown), the adjacent part 28 of the side wall 18 could be made thicker than is shown in FIG. 9, in which case the bead portion 26 could be dispensed with and it could be replaced by a curved end of the side wall 18.

The top 16 and the side wall 18 of the lid 6 are of such a thickness that the lid is able to assume a slight eliptical shape when the side wall 18 is pressed into the groove 12. This enables a reduction of the contact area between the lid 6 and the body portion 4. This in turn reduces friction between the lid 6 and the body portion 4 and thus facilitates the removal of the lid 6 from the body portion 4. As the lid 6 slides away from, the body portion 4, the contacting surface area between the lid 6 and the body portion 4 gets less and less so that the lid 6 moves easier and easier away from the body portion 4. A person opening the container 2 feels as though the lid 6 is being moved with good control. A simple squeeze and release action with one hand on the side wall 18 of the lid 6 is sufficient to cause the body portion 4 to drop into the other hand.

The side wall 10 of the body portion 4 has an inwardly inclined outer surface part 30, see FIGS. 4 and 9. This outer surface part 30 is at the end of the side wall 10 remote from the base 8. The side wall 18 of the lid 6 has an inclined part 32 between its ends, see FIGS. 7 and 9. The outer surface part 30 on the side wall 10 of the body portion 4 and the inclined part 32 on the side wall 18 of the lid 6 are such as to engage each other when the side wall 18 of the lid 6 is pressed fully into the groove 12. This engagement of the outer surface part 30 and the inclined part 32 ensures that the lid 6 is able to continue being slid away from the body portion 4 when finger pressure pressing the side wall 18 of the lid 6 into the groove 12 is released.

The top 16 of the lid 6 has an inclined shoulder part 34 as shown in FIGS. 6 and 7. This inclined shoulder part 34 is positioned adjacent an inner surface 36 of the end of the side wall 10 of the body portion 4 remote from the base 8 when the container 2 is closed. The inclined shoulder part 34 is such as to act to force any contents of the container 2 that are on the end of the side wall 10 of the body portion 4 back into the body portion 4.

As can best be seen in FIG. 4, the base 8 of the body portion 4 has a plain inner surface 38. The base 8 of the body portion 4 has a grooved outer surface containing a groove 40. The groove 40 is important from a manufacturing aspect since it enables the plastics material in the adjacent vicinity to be moulded in a substantially uniform thickness and without the need to use a mould collapsing core. If an alternative groove were to be provided at position 41, then a mould collapsing core would be needed and this would substantially double the cost of the mould for moulding the body portion 4. It is necessary to have the plastics material of a uniform thickness so that, during moulding, even cooling is achieved. With too much uneven cooling, the moulded body portion 4 could develop moulding defects.

The lid 6 has a central recessed area 42. This area 42 may be grooved if desired.

The side wall 10 of the body portion 4 has an inner surface 44 which is provided with two circumferentially extending ribs 43 as best shown in FIG. 4. The ribs 43 help to retain the contents of the container 2 in the body portion 4 if the contents are shoe polish or a similar material and the contents have started to harden, crack and have a tendency to fall out of the body portion 4. If desired, in an alternative embodiment of the invention (not shown) the inner surface 44 of the side wall 10 could be plain.

The side wall 18 of the lid 6 may have a formation (not shown) on its outer surface 46 for indicating where the side wall 18 of the lid 6 should be pressed in order to open the container 2. The formation may be a raised formation with a depression therein for receiving fingers and a thumb of a person squeezing the lid 6.

The lid 6 and/or the body portion 4 may have a formation (not shown) for preventing sealing of the body portion 4 when the container 2 is closed. As can be seen from FIG. 9, the body portion 4 has a lid-engaging part 48 which is positioned between the outer surface part 30 and the groove 12. The lid 6 has an adjacent body portion-engaging part 50.

FIG. 9 shows the container closed. The part 50 projects inwardly as shown. During closing, the part 50 passes over the part 48 and slides down the side 22 into the groove 12. The lid 6 is then maintained in a closed condition. The lid 6 is then released to open the container 2 by pressing on the side wall 18 as described above.

Figure 10:
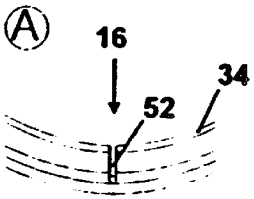
FIG. 10 is a view of arrow A shown in FIG. 7.

One or both of these parts 48, 50 may be provided with raised areas to act as the formation for preventing the sealing of the body portion 4 when the container 2 is closed. As an alternative or supplement to the raised areas, a breathing channel 52 in the lid 6 (see FIG. 10) may be employed, or any other suitable and appropriate type of formation may be employed. It is desired to prevent the lid 6 sealing to the body portion 4 when the contents of the container 2 are solvent based. If sealing occurs, the solvent cannot escape and a build up of gaseous solvent may cause the lid 6 to pop off the body portion 4.

The container 2 is for containing shoe polish for shoes or other footwear. The shoe polish can be heated to 60° C. and then run into the body portion 4, in a similar manner as known containers made of metal are filled. The temperature of 60° C. is not so high that it adversely causes stresses in the polypropylene plastics material from which the body portion 4 is moulded.

The body portion 4 and the lid 6 are produced in shapes which enable them to be moulded such that unwanted stresses in the plastics material are minimised. Unwanted stresses tend to occur when different parts of the container 2 expand or contract at different rates, and the illustrated shape for the body portion 4 and the lid 6 is intended to minimise such adverse stresses as far as possible.

As an alternative to using a hot feed gate on the outer surfaces of top 16 of lid 6 and bottom 8 of base 4 in the tooling, as on conventional plastics containers, the plastics material may be fed into the container 2 moulds from an area inside the lid 6 and base 4, so that a residual pip which is formed when the feed hole is closed, is not normally visible when the container 2 is standing on a shelf or the like. Also, the pip will then be on a part of the container 2 that will not normally be printed on. This is preferred because repeated printing over a number of pips on a number of containers 2 may tend adversely to affect the printing pad or roller being used.

The illustrated container 2 is for containing 50 ml of shoe polish. The container 2 may be made in any suitable and appropriate sizes but it will usually be such as to contain from 40–10 ml of contents. If it is. desired to make the container 2 bigger than shown, it is easy to elongate the side wall 10 of the base 8 and the various above mentioned design features can all be retained. Alternatively or in addition, the diameter of the lid 6 and the base 4 can be widened up to a point where the container can still be comfortably opened in a person's hand. For a firm feel and quick and easy opening, when the container 2 is closed, the lid 6 and the base 4 should be such that the part 36 touches a part 57 of the lid 6, the parts 48, 50 touch each other, and the parts 24, 26 also touch each other.

Referring now to FIGS. 11–14, there is shown an alternative body portion 4 in which similar parts as in previous Figures have been given the same reference numerals for ease of comparison and understanding. In FIGS. 11–14, the part 54 shown in FIG. 4 is modified such that the body portion 4 has six raised portions 56. These raised portions 56 are provided as high spots where the lid 6 and the body portion 4 meet when the container 2 is closed. The raised portions 56 are easily reduced in height for initial mould production in order to ensure that the lid 6 is not too tight a fit on the body portion 4. Also the raised portions 56 reduce friction between the lid 6 and the body portion 4 to facilitate easy opening.

It is to be appreciated that the embodiments of the invention described above with reference to the accompanying drawings have been given by way of example only and that modifications may be effected. Thus, for example, the illustrated container 2 has been described containing shoe polish. The container may however contain any other suitable and appropriate type of fluid material. Usually, the fluid material will be semi-solid or in the form of a gel. Also, the container 2 can be made of plastics materials other than polypropylene. The chosen plastics material should be chemically inert to the intended contents of the container 2. If desired, the container 2 or a part of the container 2, for example the base 8, can be made transparent or opaque so that the contents of the container 2 can be seen.

I claim:

1. A disc shaped container comprising a body portion and a lid which is a press fit onto the body portion; the body portion having a base, a circumferential side wall having an outer face with an annular groove formed in the outer face of the side wall, the groove having a pair of sides comprising a first side adjacent the base and a second side away from the base, and the lid having a top and a circumferential side wall; the container being such that the side wall overlaps the body portion side wall when the lid is on the body portion; the body portion and the lid both being made of a plastics material such that the lid side wall is pressable into said groove causing the lid side wall to engage said first side of the groove as the side wall is pressed into the groove, in order to cause the lid to separate, from the body portion with a sliding action; and the lid has an inwardly projecting body portion-engaging part adjacent the top that is engageable with the second side of said groove so that the lid is maintained in its closed position; and the lid being capable of repeated fitting to and separation from the body portion.

2. A container according to claim 1 in which the first side of the groove is a concave side.

3. A container according to claim 2 in which the body portion has a formation which leads into the concave side of the groove and which acts to facilitate an initial separating movement of the lid from the body portion, the formation being a convex formation.

4. A container according to claim 3, in which the side wall of the lid has a bead portion for sliding over the formation during the initial separating movement of the lid from the body portion,-the formation being a convex formation.

5. A container according to claim 1 in which the top and the side wall of the lid are of such a thickness that the lid is able to assume a slight elliptical shape when the side wall is pressed into the groove, thereby to reduce the contact area between the lid and the body portion and thereby to reduce the friction between the lid and the body portion and to facilitate removal of the lid from the body portion.

6. A container according to claim 1 in which the side wall of the body portion has an inwardly inclined outer surface part at its end remote from the base, and in which the side wall of the lid has an inclined part between its two ends, the inwardly inclined outer surface part of the side wall of the body portion and the inclined part of the side wall of the lid being such as to engage each other when the side wall of the lid is pressed fully into the groove, and to ensure that the lid is able to continue being slid away from the body portion when finger pressure pressing the side wall of the lid into the groove is released.

7. A container according to claim 1 in which the lid has an inclined shoulder part which is positioned adjacent an inner surface of the end of the side wall of the body portion remote from the base when the container is closed, the inclined shoulder part being such as to act to force any contents of the container that are on the end of the side wall of the body portion back into the body portion.

8. A container according to claim 1 in which the side wall of the body portion has an inner surface which is provided with at least one circumferentially extending rib.

9. A container according to claim 1 in which at least one of the lid and the body port-ion has a formation for preventing sealing of the body portion when the container is closed.

* * * * *